United States Patent [19]

Balboni

[11] Patent Number: 4,531,713

[45] Date of Patent: Jul. 30, 1985

[54] SNOW REMOVAL IMPLEMENT

[76] Inventor: Francis H. Balboni, P.O. Box 4, North Hatfield, Mass. 01066

[21] Appl. No.: 618,813

[22] Filed: Jun. 8, 1984

[51] Int. Cl.[3] ..... B66F 3/00

[52] U.S. Cl. ..... 254/131.5; 37/285; 294/54.5; 294/59

[58] Field of Search ..... 37/285; 254/131.5; 294/54.5, 59

[56] References Cited

U.S. PATENT DOCUMENTS

| | | | |
|---|---|---|---|
| 462,918 | 11/1891 | Zabel | 294/59 |
| 1142869 | 6/1915 | Alunan | 254/131.5 |
| 2,521,441 | 9/1950 | Bickley | 294/54.5 X |
| 2,720,043 | 10/1955 | Chamberlin | 37/285 |
| 3,119,596 | 1/1964 | Pratt | 294/54.5 X |
| 3,748,761 | 7/1973 | Chetwynde | 294/54.5 X |
| 4,103,954 | 8/1978 | Vaslas | 294/54.5 |

*Primary Examiner*—Edgar S. Burr

*Assistant Examiner*—Moshe I. Cohen

*Attorney, Agent, or Firm*—Chapin, Neal & Dempsey

[57] ABSTRACT

Implement for snow removal includes a snow moving blade and a tubular handle of generally rectangular configuration with a cross-bar portion for manipulation of the implement. A tubular fulcrum member, of generally rectangular configuration, is pivotably carried on the back surface of the blade for pivotable movement from a retracted position generally coplanar with the handle to an angular position in which the member serves as a fulcrum. With the pivotable member disposed as a fulcrum, the implement becomes a lever for tossing snow accumulated against the front face of the blade when the implement is pushed in plow-like manner through a snow covered area. An elastic line is fastened at one end to the handle and at its other end to the fulcrum member for returning the member to its retracted position.

4 Claims, 6 Drawing Figures

SNOW REMOVAL IMPLEMENT

BACKGROUND OF THE INVENTION

In many areas of the country, wintertime snow removal poses an arduous chore and for persons of advanced or even middle age and for those having acute back problems, the bending and lifting stresses inherent in shoveling can be hazardous to their health.

If one does not own a motorized snow plow or snow blower, the task of snow removal is invariably accomplished by using a conventional snow shovel. In manually shoveling snow from a walk or driveway, a great deal of bending, lifting and tossing is required and these actions put a heavy strain on the lower back. After each major snow storm, many snow shovelers are the victims of severe back strain and, in many cases, persons are stricken with heart attacks resulting in hospitalization and sometimes death.

The major cause of these heart attacks and back injuries is the repetitious lifting of snow loads associated with conventional snow shoveling techniques. There have, of course, been attempts in the past to overcome these problems. For example, the patent to Pratt U.S. Pat. No. 3,119,596, discloses a snow shovel with a pivotable frame whereby the snow may be tossed by lever action of the shovel. In this patent, the pivoting frame member is complicated and most awkward to use since it is always disposed so as to be dragged along the ground and is thus a major encumbrance to the use of the shovel.

Canadian Pat. No. 956,600 also shows a snow flipper apparatus which discloses an even more complex arrangement with a snow scoop which itself is pivotable relative to the handle of the apparatus. None of the prior art appears to show a simple but effective apparatus for manual snow removal.

It is the principal object of this invention to provide an improved snow removal implement of simple construction which is economical to manufacture while being practical, easy and highly effective to use with all types of snow.

The above and other objects and advantages of this invention will be more readily apparent from the following description read in conjunction with the accompanying drawings, in which.

Figure 1:
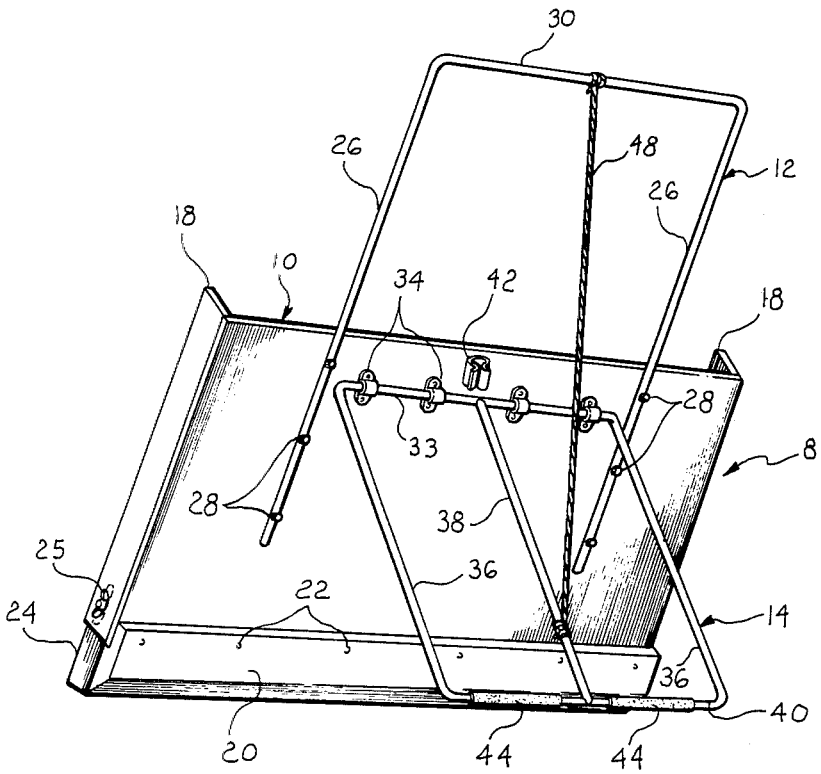
FIG. 1 is a rear perspective view, in one operative condition, of a snow removal implement of the type embodying my invention.
Figure 2:
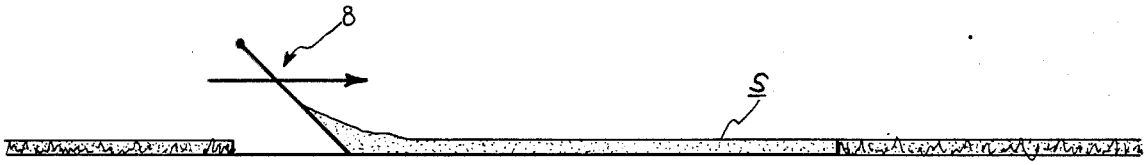
FIGS. 2–4 are diagrammatical views illustrative of the manner in which the implement of FIG. 1 is used for snow removal.
Figure 3:
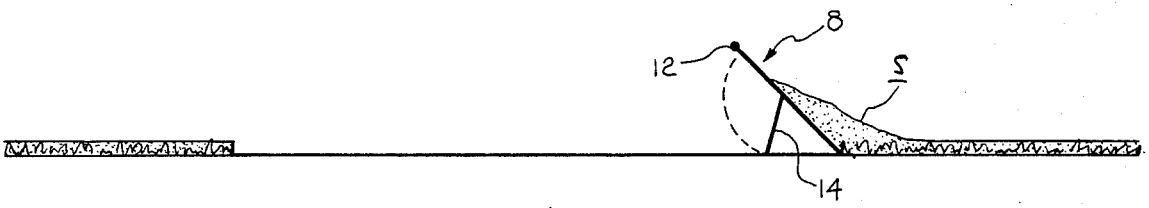
Figure 4:
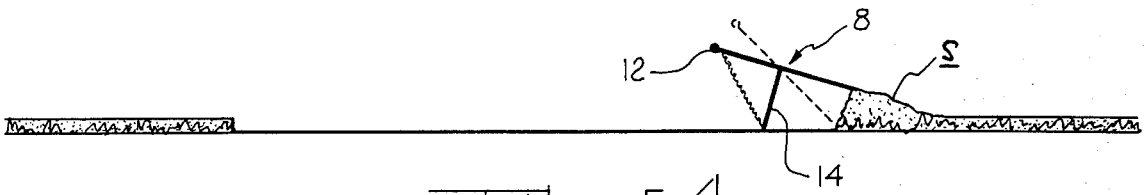

Referring in detail to the drawings, in FIG. 1 is shown a snow removal implement 8 comprising a blade or plow 10, a tubular handle 12 and a pivotable fulcrum member 14. The implement serves for clearing snow from snow covered areas, such as driveways or sidewalks. The user pushes the implement starting from one edge of the way being cleared, and as shown in FIG. 2, snow s accumulates or piles up on the blade. When the implement reaches the opposite edge of the way being cleared, the fulcrum 14 is dropped, as shown in FIG. 3. A direct downward force is then applied to the handle 12 and, as illustrated in FIG. 4, by the mechanical advantage of lever action, the snow s is tossed or flipped into a pile along the side of the path being cleared. It will be realized that this snow clearing action is accomplished entirely without the user bending and directly lifting the weight of the snow, as is common when using a conventional snow shovel. Rather by the simple lever action of this device, only downward force is required and no lifting strain is exerted on the user's lower back muscles.

The snow removal blade 10 may be a planar panel or sheet of aluminum, fiber reinforced plastic, wood or various combinations of these materials. As shown, the blade preferably includes side flanges 18 and a hardened steel plow edge 20. The front surface of the panel is preferably coated with a Teflon "non-stick" type surfacing material. The plow edge may be removably affixed to the lower edge of the blade 10 by fasteners 22 of any suitable type, such as bolts or the like. The side flanges prevent the snow from falling over the side edges of the blade 10 as it is being moved through the snow. The lower edges of the side flanges 18 may be provided with adjustable extensions 24 having fasteners 25 by which they may be aligned with the lower edge of the plow edge 20. While, as shown, the blade 10 is generally a flat sheet it will be recognized that it may also have a slight concave curvature from its top to bottom edge so that it will be capable of holding more snow than a flat blade.

The handle 12 by which the implement is pushed in the manner of a plow and pivoted for tossing or flipping snow into a pile is preferably a U-shaped, tubular material, such as aluminum. The handle includes leg portions 26 which are fastened to the back of the blade 10, such as by means of rivets or bolts 28 and an outer cross-bar portion 30. The handle is of sufficient width so that its legs 26 will impart additional strength and stability to the sheet material which forms the blade to enable the blade to accumulate and toss substantial snow loads. Because of the generous width of the handle, the user can comfortably use both hands on the cross-bar 30, spaced at approximately shoulder width, for both pushing the implement and levering the handle downwardly in a reasonably forceful manner for tossing the snow by an efficient leverage action.

Figure 5:
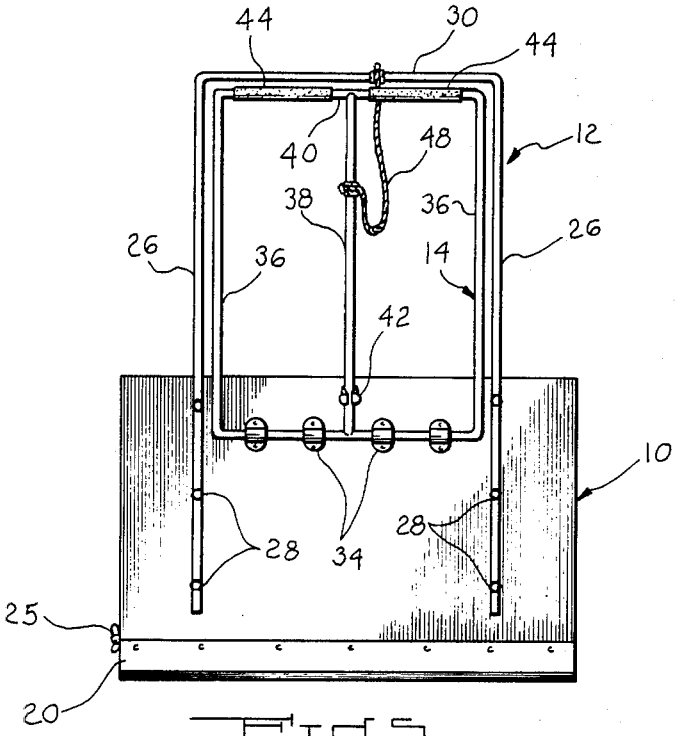
FIG. 5 is a rear elevational view of the implement in a second operative condition.
Figure 6:
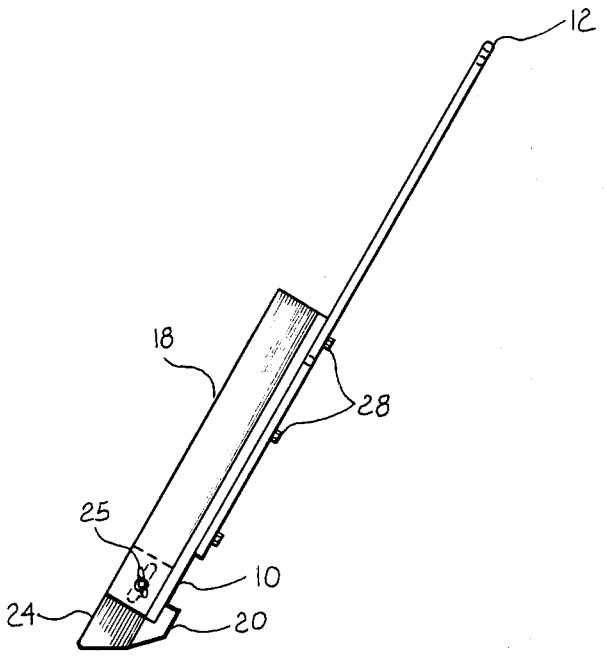
FIG. 6 is a side elevational view of the implement, as shown in FIG. 5.

Disposed within the rectangular area defined by the handle tubular 12 is pivotable fulcrum member 14. The fulcrum is a rectangular frame which generally fits within the plane of the handle, as best illustrated in FIG. 5. The fulcrum includes an inner cross-bar portion 33 by which it is pivotably connected to the back surface of the plow blade 10 by means of channel-shaped brackets 34. The fulcrum member includes side leg portions 36, a central reinforcing leg 38 and an outer, transverse or cross-bar portion 40. A spring clip retainer 42 is disposed on the back of the blade 10 and is adapted to receive the lower end portion or leg 38 by snap-fitting action to hold the fulcrum member in its retracted position within the handle frame 12. In this position, as shown in FIG. 5, the legs 36 of the fulcrum are closely adjacent and parallel with the legs of the handle 26 and the transverse bar 40 of the fulcrum is parallel and adjacent the cross-bar portion 30 of the handle 12. With this arrangement, the fulcrum member 14 tends to stabilize and reinforce the handle 12 and blade portion 10 during the snow plowing function. Moreover, the fulcrum is conveniently positioned so that it can be manually tripped or deflected from its retracted to its fulcrum position, as shown in FIG. 1. To accomplish this, it is merely required to cause the center leg 38 to be disengaged from the spring clip 42 and the fulcrum frame will thereupon, by force of gravity, drop until its outer cross-bar portion 40 contacts the ground, as best illustrated in FIGS. 1, 3 and 4. The cross-bar portion of the fulcrum is preferably sheathed within an elastomeric material, such as a foam rubber or the like, as shown at 44 in FIGS. 1 and 5. The rubberized sheathing material will assist in preventing the fulcrum from slipping on an ice or snow slicked driveway and will also cushion the impact of the cross-bar against the shins, or other body parts, of the careless user when dropping the fulcrum member.

A retrieval or return line 48 is provided to enable the fulcrum to be lifted or raised to its retracted position without requiring the user to bend down and pick it up by hand. Preferably, the return line should have some longitudinal elasticity and it has been found that a bungee cord, fastened at one end to the cross-bar 30 and at its other end to center leg 38 of the fulcrum frame, functions quite well for this purpose.

The manner of using this snow removal implement will best be appreciated by reference to FIGS. 2–4. The user will normally start at one edge of a walk or driveway, for example, and will simply push the implement across the width of the driveway at a vertical angle relative to the ground of about 45%. When the lower edge of the blade 10 reaches or contacts the opposite edge of the driveway, the user will then trip or drop the fulcrum frame simply by using his fingertips while still firmly holding the cross-bar 30 of the handle 12. This is important since it will be realized that one would not want to release the handle while the blade holds a large and sometimes very heavy load of wet snow. Since the handle 12 and blade 10, which form a lever, are essentially coplanar, the handle may be tilted as necessary or desirable so that the fulcrum will come to rest on the ground at an angle $\theta$ relative to the lever. For best results depending upon the height and strength of the operator and the weight of the snow, this angle may vary from about 30°–60° and in the ideal situation, would be about 45°. Of course, each user, depending on all the circumstances of each particular situation, will by trial and error, readily determine the most comfortable and effective operating parameters for both the plowing and snow tossing operations. When the fulcrum is properly positioned on the ground, the user will place one or both feet on the cross-bar 40 to hold it in fixed position and then with both hands on the cross-bar 30, lever the handle downwardly, as shown in FIG. 4, so as to toss or flip the snow s into a pile or bank along the edge of the way being cleared.

It will be recognized that the implement embodying the principles of my invention may be made in various sizes and models. For example, a smaller snow removal blade may be marketed for use by women and senior citizens to enable smaller snow loads to be more easily handled.

Having thus described my invention, what is claimed is:

1. Snow removal implement comprising a snow pushing blade, a handle including a cross-bar portion and leg portions affixed to the backside of said blade, said handle and blade being generally coplanar, a fulcrum member disposed between the leg portions of the handle and pivotably connected to said blade, said fulcrum being a generally rectangular frame dimensioned to fit within the handle in coplanar relation therewith, said fulcrum being pivotable for movement from and to a ground engaging position at an oblique angle to the plane of the handle and blade to and from a retracted position generally coplanar with said handle, and a retrieval line extending from the handle to said fulcrum for returning said fulcrum from its ground engaging position to its retracted position.

2. Snow removal implement as set forth in claim 1, in which said blade is generally rectangular and said handle is a tubular member which defines with the upper edge of said blade a rectangle and said fulcrum member includes a transverse bar portion disposed parallel and contiguous to the cross-bar portion of the handle for manipulation of said fulcrum while holding said handle, said retrieval line being an elastic cord.

3. Snow removal implement as set forth in claim 2, in which said blade includes a removable hardened steel plow edge and the side edges of said blade include upstanding flanges.

4. Snow removal implement as set forth in claim 2, in which a spring clip is provided to releasably retain said fulcrum in its retracted position.

* * * * *